US006543813B1

(12) United States Patent
Koberlein

(10) Patent No.: US 6,543,813 B1
(45) Date of Patent: Apr. 8, 2003

(54) CONVERSION SYSTEM FOR OIL RETURN CONNECTION TO SKID STEER AND OTHER APPARATUS

(75) Inventor: Ross Koberlein, Brownstown, IL (US)

(73) Assignee: Worksaver, Inc., Litchfield, IL (US)

( * ) Notice: Subject to any disclaimer, the term of this patent is extended or adjusted under 35 U.S.C. 154(b) by 0 days.

(21) Appl. No.: 09/565,618

(22) Filed: May 4, 2000

Related U.S. Application Data

(60) Provisional application No. 60/132,953, filed on May 7, 1999.

(51) Int. Cl.[7] ..... F16L 55/00

(52) U.S. Cl. ..... 285/148.19; 285/369; 285/901

(58) Field of Search ..... 285/148.19, 148.22, 285/148.23, 179, 179.1, 369, 383, 901; 180/69.21, 9.36, 6.4, 306, 6.2; D12/197

(56) References Cited

U.S. PATENT DOCUMENTS 320,645 A * 6/1885 Fischer ..... 285/148.22 X
4,893,846 A * 1/1990 McGraw ..... 285/148.23
5,158,327 A * 10/1992 Rowe ..... 285/38
5,411,114 A * 5/1995 Bedi et al. ..... 285/148.22 X
5,901,887 A * 5/1999 Wark ..... 285/148.22 X

OTHER PUBLICATIONS

Bobcat Attachments, Multi–Purpose, published by Melrose Company N. B–1595.

* cited by examiner

*Primary Examiner*—Jack Lavinder
*Assistant Examiner*—Melanie Torres
(74) *Attorney, Agent, or Firm*—Paul M. Denk

(57) ABSTRACT

A hydraulic hose for use for adapting a skid loader or other apparatus for connecting thereto a hydraulic post driver, the hose assembly includes a fill cap at one end, for connecting with the hydraulic system of the loader, and a fitting at the other end, for connecting with the hydraulic inlet for the post driver. The hydraulic hose has sufficient length, to allow for its looping between these two components, when assembled, and to accommodate any movement of the post driver, relative to the loader, during its application and usage.

11 Claims, 7 Drawing Sheets

CONVERSION SYSTEM FOR OIL RETURN CONNECTION TO SKID STEER AND OTHER APPARATUS

CROSS-REFERENCE TO RELATED APPLICATION

This application is a non-provisional patent application based upon a provisional patent application having Ser. No. 60/132,953, filed on May 7, 1999, which is owned by the same inventor.

BACKGROUND OF THE INVENTION

In the agricultural world, and also in the construction trade, skid steer units have been very popular, and have attained wide spread usage. In addition, other types of equipment, for use for a variety of purposes, such as back hoes, and other types of apparatus, have long been in use. All of this type of equipment has very specific usage, and their conversion and adaptation for usage with other accessories and implements, has not necessarily been done.

In the case of the current invention, it is designed for converting a skid steer, or a skid loader, through adaptation of its hydraulic system, for application of a hydraulic post driver thereto, to allow the same equipment to be utilized for an entirely different purpose, and that is for driving a fence post, or the like, into an implanted position.

Examples of prior art type of equipment that may be utilized for this purpose can be seen in FIG. 1, which discloses a skid-steer loader that is currently used in the art. FIG. 2 shows another form of skid steer, that has specific usage for movement of earth, or other materials, of a heavier nature.

FIG. 3 of this disclosure discloses how a skid steer may be converted, at its front end, to have connected thereto a post driver, through adaptation of the hydraulic system of the apparatus, that interconnects with the hydraulic system of the post driver, to make it convertible for usage for post driving purposes.

An example of the type of hydraulic post driver that may be used in combination with this invention as shown in the U.S. Pat. No. 5,282,511, relating to a post driver with improved bearing means, and which post driver is of a hydraulic type. This prior patent, along with this current application, are owned by a common assignee.

SUMMARY OF THE INVENTION

The object of this invention, and the principal purpose for it, is to provide more versatility in the usage of a skid steer apparatus. The conversion of the skid steer as described herein, the applicant has developed various and different types of hydraulic post drivers, that may fit onto most loaders, as known in the art. By adapting the hydraulic system for the skid steer, and connecting the post driver to the front of the loader, the skid steer can be readily adapted and used for driving heavy posts into the ground, as for use for fence posts, construction purposes, and for other applications. The stabilizer legs, and the universal quick-attached frame assembly provides for easy hookup of the driver so as to immediately turn the skid steer into a true work saver, for use for driving posts into the ground.

The unique requirement of a hydraulic post driver is that the return oil must be put directly into the hydraulic oil reservoir. It cannot go through a hydraulic quick coupler as the restriction will slow the oil flow and the post driver ram will lose much of its driving force. Hydraulic oil reservoirs need to be vented. Some skid steer oil tanks have separate vent tubes but many use the oil fill cup as the venting means. The invention of the hose/cap combination allows the oil to be returned to the oil reservoir but keep the system sealed so dirt won't enter and contaminate the oil. It also allows us to use the vented cap where needed without having to establish an alternative venting means.

The skid steer operator simply removes the regular skid steer oil fill cap, and installs a hose/cap combination to the hydraulic system, and then connects the post driver return line to it. Then, the hydraulic system of the skid steer can be operated, to provide for the substantial hydraulic pressure needed to allow a heavy force to be exerted by the post driver, for driving of one or more posts into the ground. When the task is completed, and when the operator is done with the post driver, he simply reverses the hydraulic hose system, from the previous procedure of its installation, and reapplies the skid steer back to its original operating condition for other skid steer applications.

The foregoing is a simple idea to provide for ready application, and adaptation, of the hydraulic system of the skid steer, for making it adaptable for usage for post driving, and thus far, in the art, others are simply sticking the return line of the hydraulic system into the oil fill neck, while others are cutting holes into the side of the oil reservoir tank, system, and operate such implements off of its hydraulic system and power. The hose/cap invention allows the return hose to be securely connected to the oil reservoir and provide a tight, clean connection that prevents dirt from entering the oil reservoir.

As can be seen in FIG. 4, the post driver is attached to a skid loader. The return hose must be securely connected to the hydraulic reservoir fill system. The use of a special fill cap, and hose assembly, of this invention, can be used for adapting the hydraulic system for this supplemental purpose of connecting the post driver directly to the skid loader, during its usage and application. FIG. 5 discloses the routing of the heavy return hydraulic hose. That is the hose delineated at 1. The hose attaches at one end to the driver ram valve of the hydraulic post driver, while the opposite end connects by means of its fill cap to the hydraulic system of the shown skid loader. These fill caps for the skid loader are common upon most models of the same, and can readily accommodate the hydraulic conversion kit of this invention.

The purpose for the return hose having ample clearance, which is provided with sufficient loop between its securing points, is to allow freedom of movement of the driver, with respect to its mounting to the skid loader, during its usage and operation. The loader arms of the hydraulic post driver should never be raised more than three or four feet above the ground. During operation, the post driver feet should always be resting securely upon the ground. One should never have the driver suspended when driving a post or operating the driver. The down pressure on the feet will help stabilize the driver for post alignment and driving of a post into the ground.

FIGS. 6 and 7 disclose the routing of the heavy hydraulic return hose. There is a loop provided in the hose, as noted, from the location where the hose attaches to the driver ram valve, and to where the plastic tie strap secures it to the main cross member 2 of the loader.

FIGS. 8 and 9 disclose how the fill cap on the side of the skid steer of the main loader arm may go up and down only a slight distance, during usage, and to accommodate such, some additional slack in the routing of the hose along side of the loader arm may be secured by one of the plastic tie straps, as previously referred to. The hose is routed over the top of the loader cap and secured with another tie strap thereto. The special filler cap and hose assembly routes over the side of the cab and down to the reservoir fill. The original fill cap for the hydraulic system of the loader is removed, and stored. Then, the special fill cap of this invention is secured thereto, which applies the opposite end of the hydraulic hose directly to the hydraulic system of the skid steer, and ready for usage and application. The strainer screen of the hydraulic system is left in place, and the special hose and fill cap are connected thereto, to provide hydraulic return. The hose is held steady while the new fill cap is screwed into position.

DESCRIPTION OF THE PREFERRED EMBODIMENT

Figure 1:
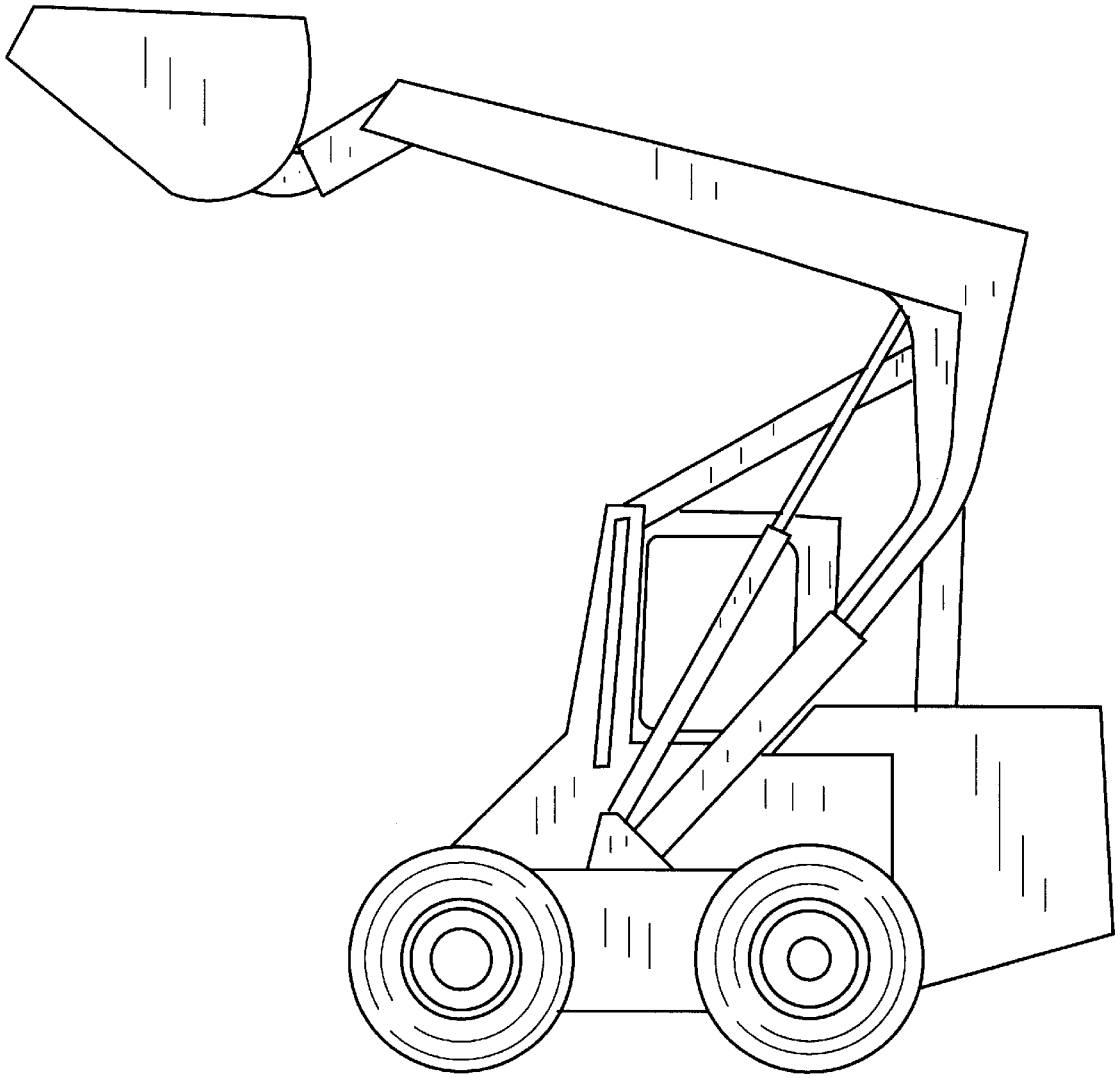
FIG. 1 discloses a skid steer loader as currently used in the art.
Figure 2:
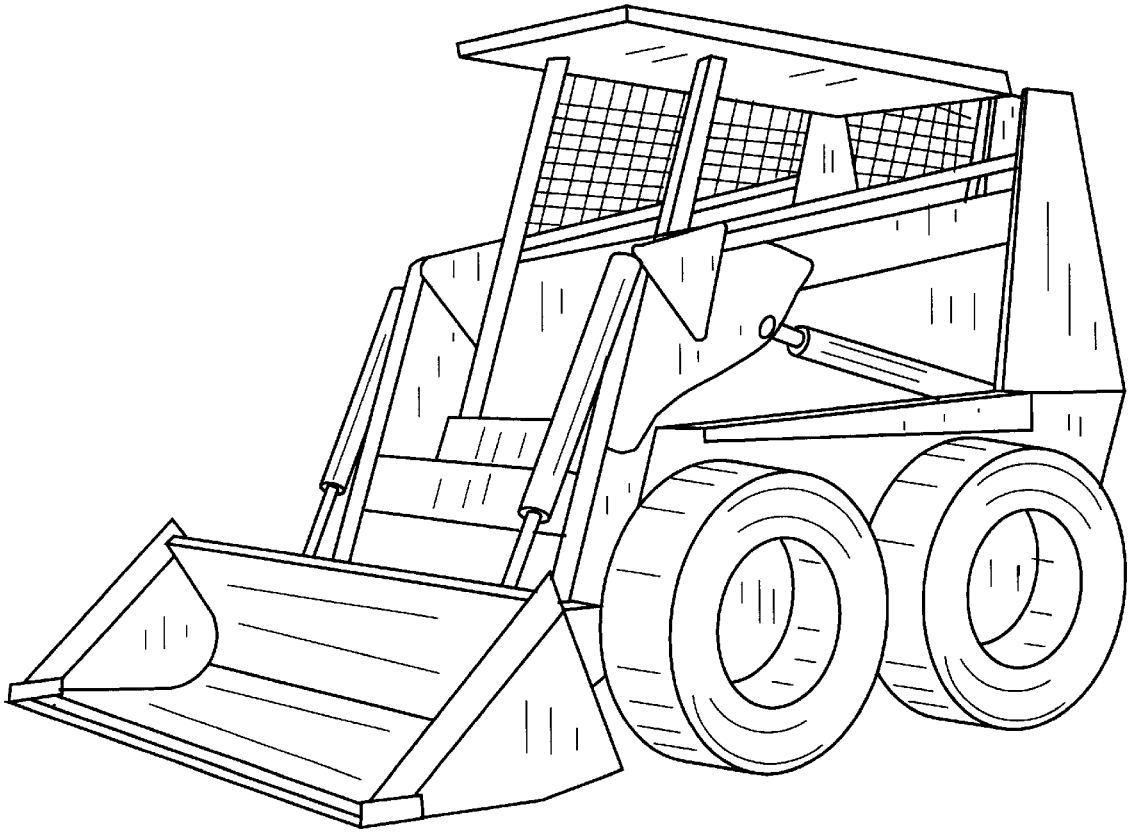
FIG. 2 shows another form of a skid steer, for use for movement of earth, etc.
Figure 3:
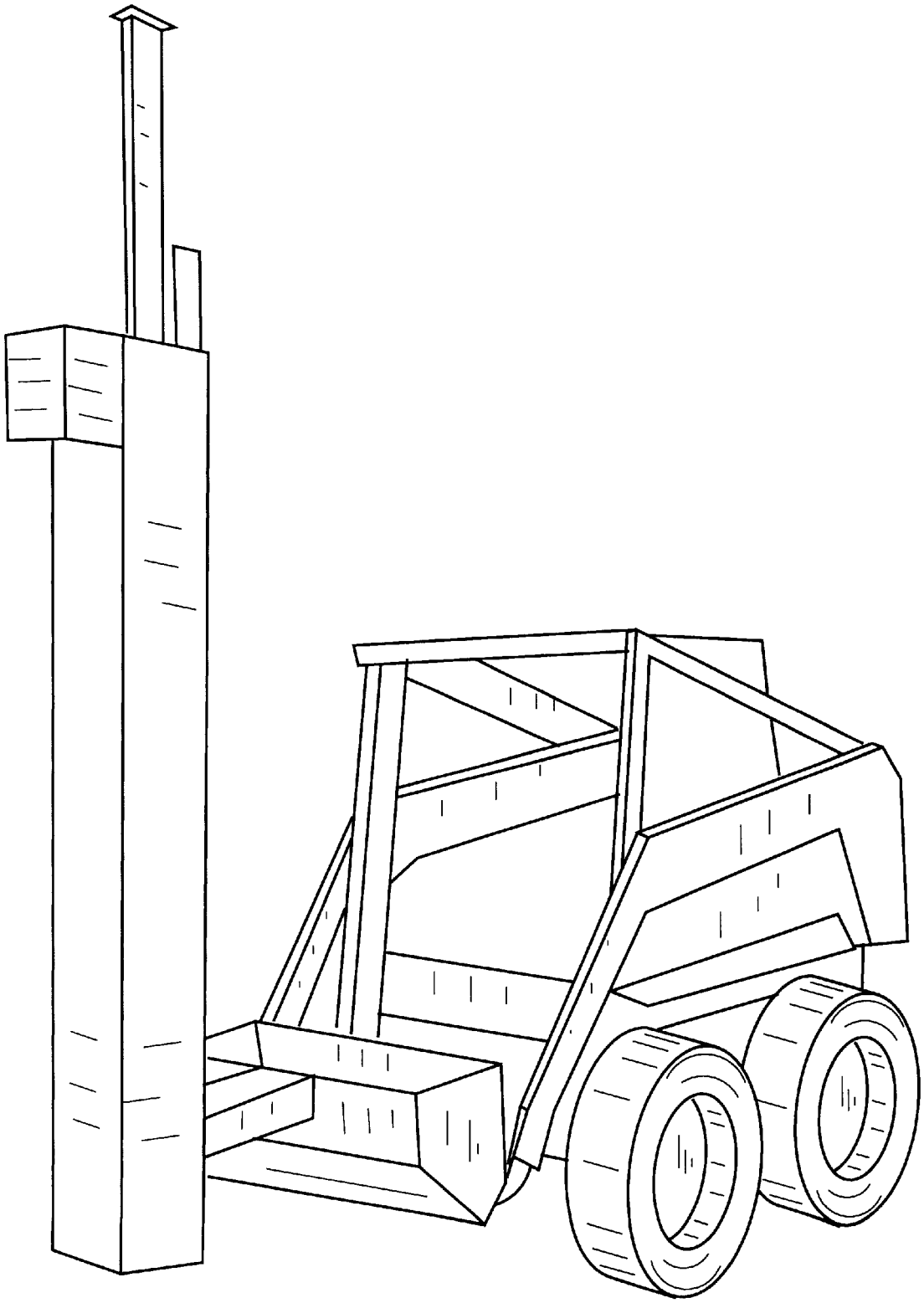
FIG. 3 shows a skid-steer that may be converted to connect with a post driver.
Figure 4:
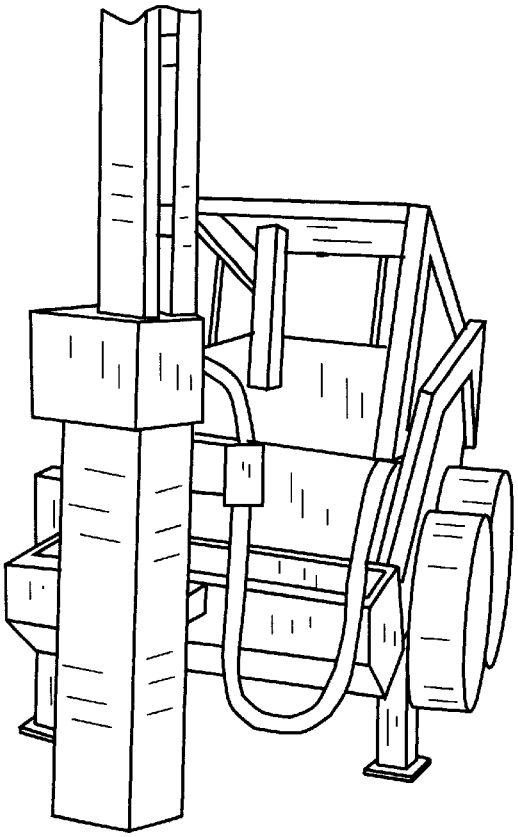
FIG. 4 discloses the post driver attached to a skid loader.
Figure 5:
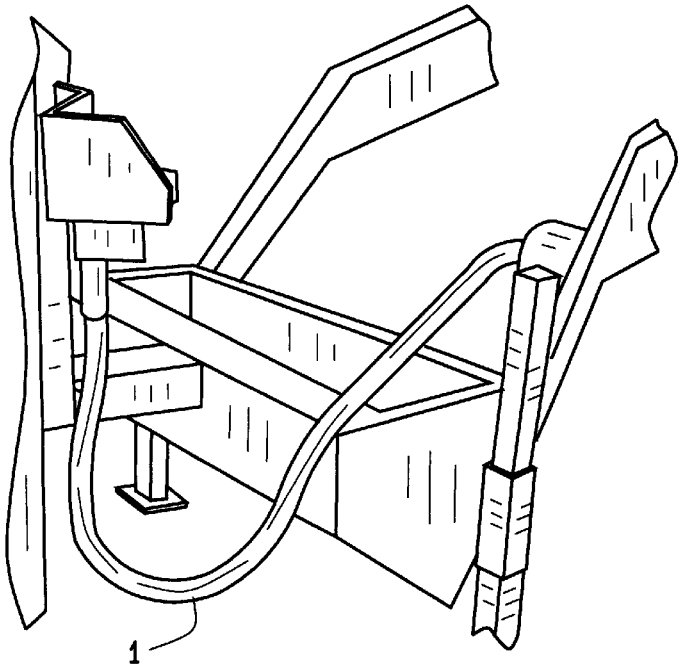
FIG. 5 discloses the routing of the heavy return hydraulic hose line from the post driver to the hydraulic pump of the machine.
Figure 6:
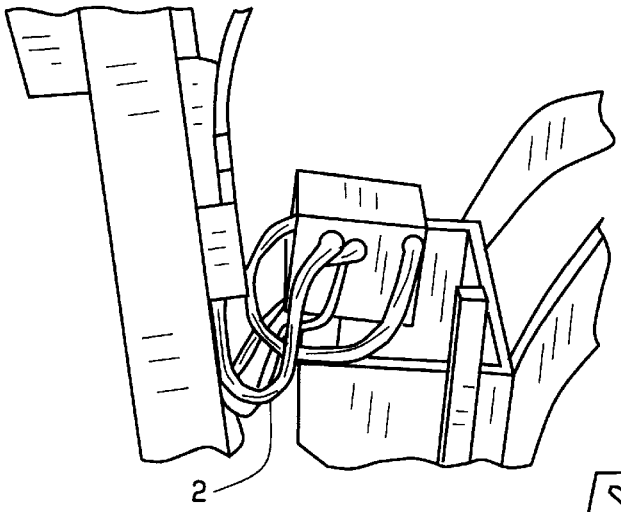
FIG. 6 discloses the routing of the heavy hydraulic return hose.
Figure 7:
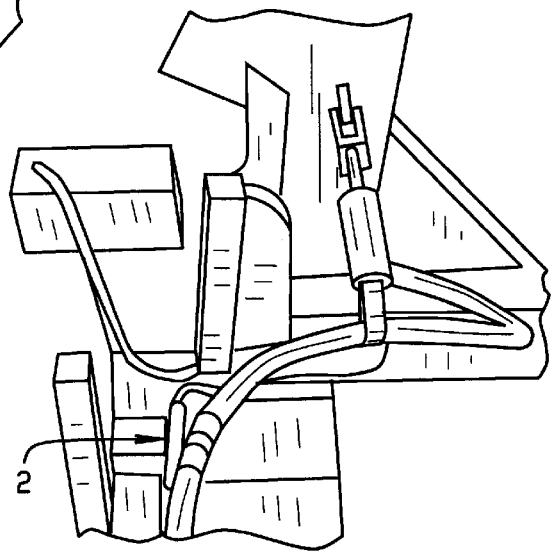
FIG. 7 also discloses the routing of the heavy hydraulic return hose.
Figure 8:
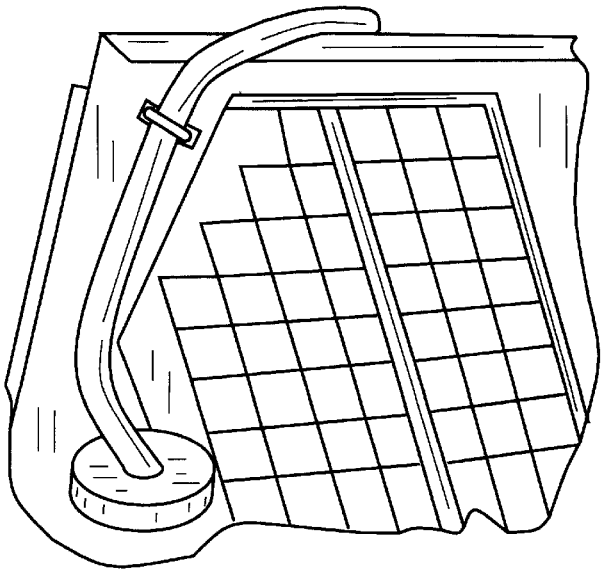
FIG. 8 discloses the connection of the hydraulic hose to the fill cap of the skid steer.
Figure 9:
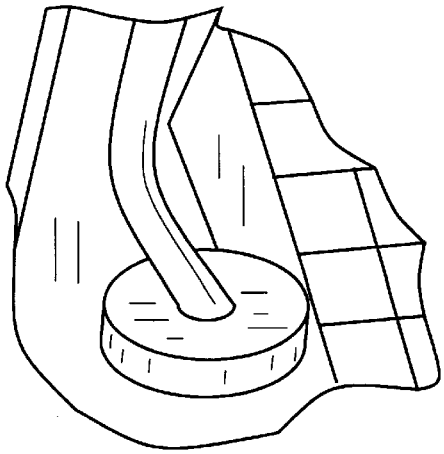
FIG. 9 discloses the connection of the hydraulic hose to the fill cap of the hydraulic reservoir.
Figure 10:
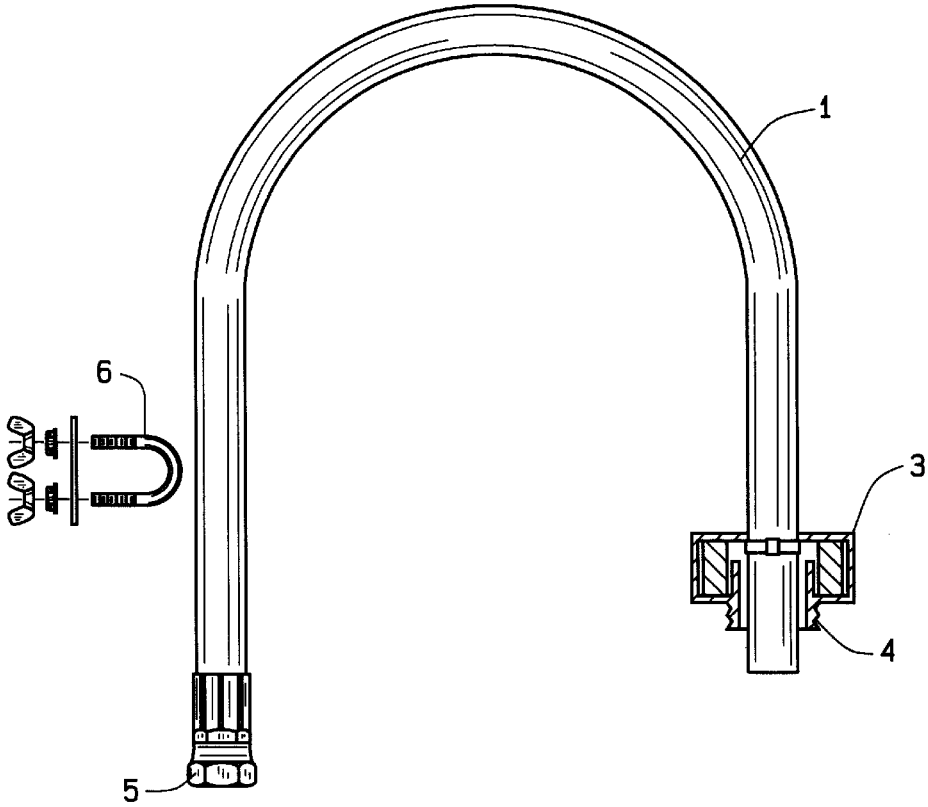
FIG. 10 discloses a machined filler cap for cooperating with the return hydraulic hose line.

In referring to FIG. 10 of the drawings, the particular hydraulic kit for application of the hydraulic hose assembly directly to the skid loader, and to the hydraulic post driver, is readily disclosed. Its fill cap 3 connects the return end of the hydraulic hose 1, and contains the usual threads 4 to allow threading of the cap, and installation of the hydraulic hose, directly to the hydraulic system of the loader. The opposite end of the hydraulic hose 1 includes a threaded fitting 5, which can clamp directly onto the hydraulic intake for the post driver, as understood. Various types of clamps or U-bolts, as at 6, may be employed for securing of the hydraulic hose to the various instruments, to assure stability in their mounting and installation, as during usage. But, such a hose can be readily removed, by simply unscrewing of the fill cap 3, from the hydraulic system of the loader.

Figure 11:
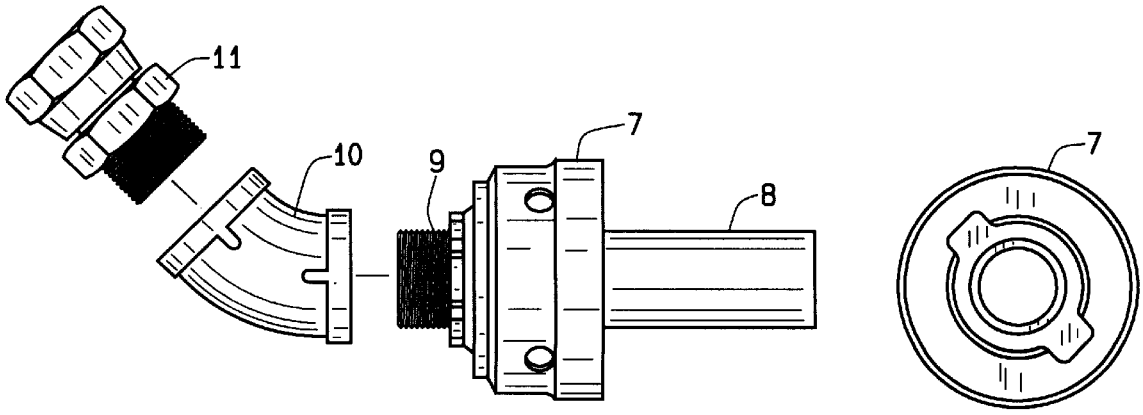
FIG. 11 shows a machined filler cap and the pipe and hydraulic fittings to make a special filler cap assembly that goes on the oil reservoir fill neck.

FIG. 11 discloses a special fill cap, for connection to the hydraulic reservoir case. The cap 7 includes an inner segment of the hydraulic hose line 8, connecting with the cap, and the cap may threadedly engage onto the hydraulic reservoir. The upper end of the cap, or the upper extension of the hydraulic pipe 8 includes a threaded upper end 9, which connects with an elbow 10, and which further connects with a fitting 11, which has the hydraulic hose (not show) connected thereto. This is a machined filler cap which incorporates pipe and hydraulic fittings to make a "special" filler cap assembly that goes onto the oil reservoir fill neck of the machinery.

Figure 12:
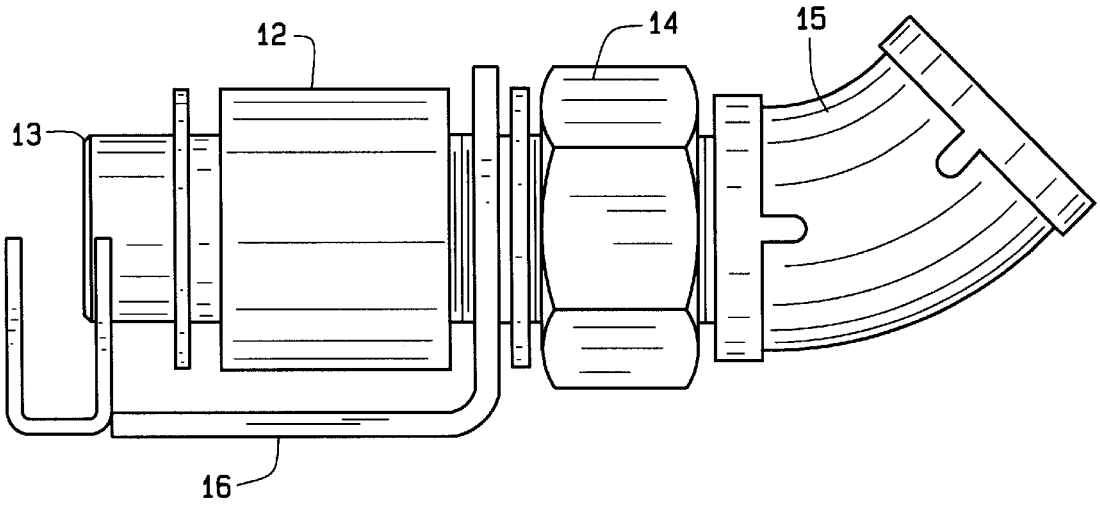
FIG. 12 discloses the assembly for providing a modified filler cap, that fits onto the oil reservoir fill neck, and for attaching the hydraulic hose thereto.

FIG. 12 shows another special fill cap for use for either the flow or return of hydraulic fluid from its operations of an attachment to the tractor, machinery, or the like In this particular instance, the hose segment of the hydraulic hose, as at 12, connects onto the outer end of the fitting flow pipe 13, or its center tube weldment, and this connects by means of a threaded fitting 14 to an elbow 15, that may connect with the hydraulic reservoir. The retainer weldment 16 is designed to provide the means for holding the hydraulic hose in place, upon the fill cap.

Variations or modifications to the subject matter of this invention may occur to those skilled in the art upon reviewing the disclosure as provided herein. Such variations, or modifications, if within the spirit of this invention, are intended to be encompasses within the scope of the disclosure as provided therein. The description of the preferred embodiment is set forth for illustrative purposes only.

I claim:

1. A special filler cap for a hydraulic oil reservoir of a skid steer unit and for use with hydraulically powered equipment, comprising:

a cap body capable of threadedly engaging a filler of the hydraulic oil reservoir of the skid steer unit, said cap body having an outer surface and an inner surface;

an inner segment of hydraulic line at the inner surface of the cap body capable of insertion into the hydraulic oil reservoir of the skid steer unit; and a fitting at the outer surface of the cap body capable of attachment to the hydraulic line of hydraulically powered equipment whereby the hydraulically powered equipment is connected to and powered by the hydraulic oil reservoir of the steer skid unit.

2. The special filler cap for a hydraulic oil reservoir of a skid steer unit of claim 1 further comprising an elbow position between said fitting and said outer surface of said cap body.

3. The special filler cap for a hydraulic oil reservoir for a skid steer unit of claim 1 wherein the piece of hydraulically powered equipment is a post driver.

4. A method of accessing the hydraulic oil in a hydraulic oil reservoir of a skid steer unit to operate a hydraulically operated attachment for the skid steer unit comprising:

removing a filler cap from the hydraulic oil reservoir of a skid steer unit;

attaching an assembly to the hydraulic oil reservoir; said assembly including a reservoir fitting for attachment to the hydraulic oil reservoir, a hydraulic line segment at an inner surface of the cap body for introduction into the hydraulic oil reservoir and a hydraulic line fitting at an outer surface of the reservoir fitting;

attaching a hydraulic line from the hydraulically operated attachment to the hydraulic line fitting, thereby accessing the hydraulic oil in the hydraulic oil reservoir of the skid steer unit for operation of the hydraulically operated attachment.

5. The method of accessing the hydraulic oil in a hydraulic oil reservoir of a skid steer unit to operate a hydraulically operated attachment for a skid steer unit of claim 4 wherein the "method" in order to more appropriately describe the limitations of the claims as method limitations and not apparatus limitations comprises applying an elbow between the hydraulic line fitting and the outer surface of the reservoir fitting.

6. The method of accessing the hydraulic oil in a hydraulic oil reservoir of a skid steer unit to operate a hydraulically operated attachment for the skid steer unit of claim 4 wherein the reservoir fitting is a filler cap.

7. The method of accessing the hydraulic oil in a hydraulic oil reservoir of a skid steer unit to operate a hydraulically operated attachment for the skid steer unit of claim 4 wherein the "method" in order to more appropriately describe the limitations of the claims as method limitations and not apparatus limitations comprises applying an elongated segment of hydraulic line between the hydraulic line fitting and the reservoir fitting.

8. The combination of a hydraulic hose and cap assembly for accessing hydraulic oil in a hydraulic oil reservoir of a skid steer unit, and for use with a hydraulically operated attachment, comprising:

a hydraulic reservoir cap, said cap having an opening form centrally therein, and said cap capable of threadedly engaging with the hydraulic oil reservoir of a skid steer unit;

a hydraulic hose length having a first end extending through said opening in said hydraulic reservoir cap and for insertion into the hydraulic oil reservoir; and a hydraulic line fitting at a second end of said hydraulic hose, said hydraulic line fitting adapted to access a hydraulic system of a hydraulically operated attachment for the skid steer unit whereby hydraulic oil in the hydraulic oil reservoir of the skid steer unit is used to operate the hydraulically operated attachment.

9. The hydraulic hose and cap assembly for accessing hydraulic oil in a hydraulic oil reservoir of a skid steer unit of claim 8 wherein the hydraulically operated attachment is a post driver.

10. An assembly for accessing hydraulic oil in a hydraulic oil reservoir of a skid steer unit and providing for the operation of a hydraulically operated attachment for the skid steer unit, comprising:

a hydraulic flow pipe having a first and second end;

a hydraulic reservoir fitting at said first end of said hydraulic flow pipe capable of attachment to and inserting into the hydraulic oil reservoir of the skid steer unit;

a hydraulic hose length at said second end of said hydraulic flow pipe, said hydraulic hose length adapted to "method" in order to more appropriately describe the limitations of the claims as method limitations and not apparatus limitations hydraulic a line of the hydraulically operated attachment for the skid steer unit.

11. The assembly of claim 10 further comprising a welldonment for securing the hydraulic hose length in place.

* * * * *